US007176636B2

(12) United States Patent
Beij et al.

(10) Patent No.: US 7,176,636 B2
(45) Date of Patent: Feb. 13, 2007

(54) CIRCUIT ARRANGEMENT FOR OPERATING A LAMP

(75) Inventors: Marcel Beij, Eindhoven (NL); Arnold Willem Buij, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 23 days.

(21) Appl. No.: 10/495,951

(22) PCT Filed: Nov. 6, 2002

(86) PCT No.: PCT/IB02/04675

§ 371 (c)(1),
(2), (4) Date: May 18, 2004

(87) PCT Pub. No.: WO03/045118

PCT Pub. Date: May 30, 2003

(65) Prior Publication Data

US 2005/0012469 A1 Jan. 20, 2005

(30) Foreign Application Priority Data

Nov. 23, 2001 (EP) ..... 01204530

(51) Int. Cl.
*H05B 37/02* (2006.01)

(52) U.S. Cl. ..... 315/291

(58) Field of Classification Search ..... 315/224, 315/291, 307, 308, DIG. 5
See application file for complete search history.

(56) References Cited

U.S. PATENT DOCUMENTS

| | | | | | |
|---|---|---|---|---|---|
| 4,404,616 | A * | 9/1983 | Miyanaka et al. | ..... | 361/253 |
| 5,583,399 | A * | 12/1996 | Rudolph | ..... | 315/291 |
| 5,589,740 | A * | 12/1996 | Rudolph et al. | ..... | 315/291 |
| 5,663,313 | A * | 9/1997 | Hawkins et al. | ..... | 536/23.1 |
| 5,877,592 | A * | 3/1999 | Hesterman et al. | ..... | 315/106 |
| 6,153,987 | A * | 11/2000 | Toda et al. | ..... | 315/308 |
| 6,160,352 | A * | 12/2000 | Steinel | ..... | 315/156 |
| 6,281,642 | B1 * | 8/2001 | Konishi et al. | ..... | 315/308 |
| 6,426,597 | B2 * | 7/2002 | Rast et al. | ..... | 315/219 |
| 6,489,730 | B2 * | 12/2002 | Ito et al. | ..... | 315/219 |
| 6,597,118 | B2 * | 7/2003 | Arimoto et al. | ..... | 315/115 |

* cited by examiner

*Primary Examiner*—Tuyet Vo
*Assistant Examiner*—Minh Dieua

(57) ABSTRACT

In an electronic ballast circuit equipped with lamp presence detection means that generate a current flowing through one of the lamp electrodes the detection means are periodically switched off. The power dissipated by the lamp presence detection means is thereby reduced.

3 Claims, 1 Drawing Sheet

CIRCUIT ARRANGEMENT FOR OPERATING A LAMP

This application is a 371 of PCT/IB02/04675 Nov. 6, 2002

BACKGROUND OF THE INVENTION

The invention relates to a circuit arrangement for operating a lamp comprising

- input terminals for connection to the poles of a voltage supply source,
- a circuit part I coupled to the input terminals for igniting the lamp and for generating a lamp current out of a supply voltage delivered by the supply voltage source,
- a circuit part II, coupled to circuit part I, for detecting the presence of a lamp comprising
  - a circuit part III for generating a current through an electrode of the lamp,
  - a circuit part IV for detecting the current through the electrode of the lamp.

Such a circuit arrangement is known. The current through the electrodes can be a DC current or a AC current. The circuit part III can be realized in many different ways. For instance circuit part III may comprise means for supplying a DC voltage source but may alternatively comprise a switched mode power supply such as a bridge circuit for supplying a high frequency AC current to the electrodes. In the latter case the circuit part III may comprise a transformer equipped with secondary windings that are coupled to the lamp electrodes. The circuit part II makes it possible for the circuit arrangement to check whether a lamp is actually present before attempts to ignite the lamp are made. No ignition voltage is generated in case the circuit part II detects that no lamp is present. Thereby damage to components in the circuit arrangement due to high currents and voltages is prevented. Similarly, in case a burning lamp is disconnected from the circuit arrangement or the electrode of the lamp is broken, the circuit part II detects whether a new lamp is connected to the circuit arrangement or when the lamp with the electrode failure is replaced by a new lamp. In order to make sure that the new lamp that is connected to the circuit arrangement is immediately detected and ignited, the circuit part II operates continuously. A disadvantage associated with this continuous operation, however, is that the current generated by circuit part III continuously dissipates power.

SUMMARY OF THE INVENTION

The invention aims to provide a circuit arrangement for operating a lamp in which lamp presence can be detected at any time and in which the lamp detection consumes only a very limited amount of power.

A circuit arrangement as mentioned in the opening paragraph is therefor in accordance with the invention characterized in that the circuit arrangement further comprises a circuit part V for periodically activating and deactivating circuit parts III and IV.

In a circuit arrangement according to the invention, circuit part III is not operative all the time but only a predetermined fraction of each period in which circuit part III is subsequently activated and deactivated. As a result the amount of power dissipation caused by the current generated by the circuit part III is considerably lowered.

On the other hand, since circuit parts III and IV are activated in each period the connection of a new lamp, after a lamp has been disconnected from the circuit arrangement or has become defective, is always detected within the duration of a period. A proper choice of the duration of one period can assure that a new lamp will be detected and ignited in such a short time lapse that a user will hardly notice any delay.

A preferred embodiment of a circuit arrangement according to the invention is characterized in that the circuit part V comprises means for gradually increasing the amplitude of the current through the electrode during a first time interval, maintaining the amplitude of the current through the electrode at a substantially constant value during a second time interval and gradually decreasing the amplitude of the current through the electrode during a third time interval. The gradual increase and decrease of the amplitude of the current generated by circuit part III prevents interference and under some conditions mechanical noise.

A further preferred embodiment of a circuit arrangement according to the invention is characterized in that the circuit part V is equipped with delay means for activating the circuit part IV a predetermined delay time interval after the activation of circuit part III. It has been found that, depending on the nature of circuit part III, the current that is generated by circuit part III immediately after circuit part III has been activated, does not always only flow through the lamp electrode. For instance if there are parasitic capacitances, part of the current will flow through these parasitic capacitances until they are charged. Alternatively, in case the circuit part III comprises a switched mode power supply incorporating for instance magnetics, these magnetics have to be saturated to a certain extent before the switched mode power supply generates a current that actually flows through the lamp electrode. In these cases as well as in case the amplitude of the current through the lamp electrode is gradually increased, a reliable detection of such a current directly after circuit part III has been activated is not possible. In the further preferred embodiment this problem is overcome by making sure that circuit part IV is only activated and the current through the electrode is only detected when the predetermined delay time interval has lapsed after the activation of circuit part III.

BRIEF DESCRIPTION OF THE DRAWINGS

An embodiment of a circuit arrangement according to the invention will be explained making reference to a drawing. In the drawing

DETAILED DESCRIPTION OF THE PREFFERED EMBODIMENTS

Figure 1:
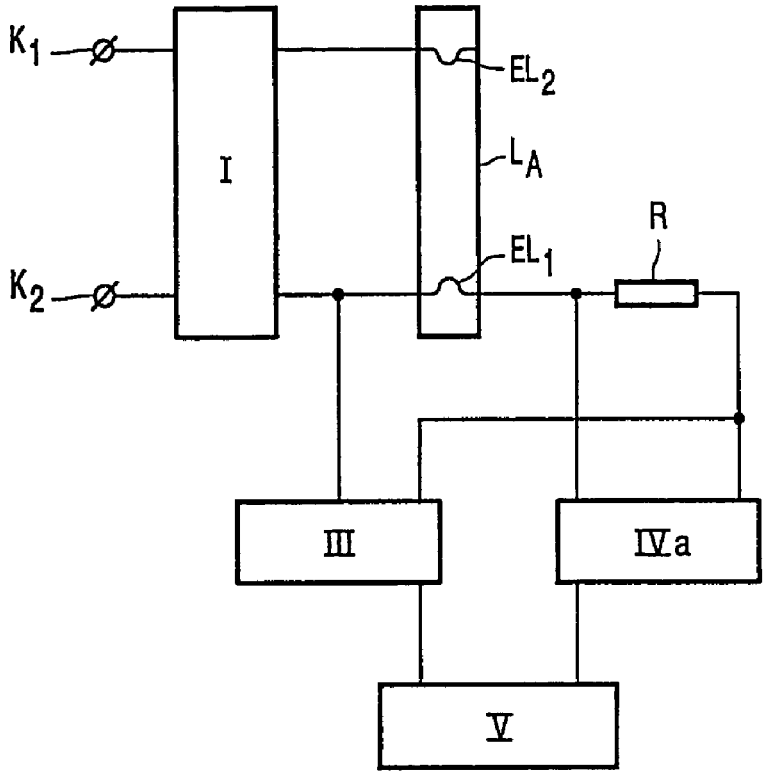
FIG. 1 shows an embodiment of a circuit arrangement according to the invention with a lamp connected to it.

In FIG. 1, K1 and K2 are input terminals for connection to the poles of a voltage supply source. Input terminals K1 and K2 are connected to respective inputs of circuit part L. Circuit part I is a circuit part for igniting a lamp and generating a lamp current out of a supply voltage delivered by the supply voltage source. A lamp La is connected to output terminals of circuit part I. The lamp La is equipped with electrodes E11 and E12. III is a circuit part for generating a current through an electrode of the lamp La. A first output terminal of circuit part III is connected to a first end of electrode E11. A second end of electrode E11 is connected to a first end of ohmic resistor R. A second end of ohmic resistor R is connected to a second output of circuit part III.

In the embodiment shown in FIG. 1, circuit part III is voltage source for supplying a DC voltage. The current through electrode E11 generated by the circuit part III therefor is a DC current. It is noted, however, that in alternative embodiments of a circuit arrangement according to the invention the circuit part III may comprise a switched mode power supply such as a bridge circuit for supplying a high frequency AC current to the electrodes. In the latter case the circuit part III may comprise a transformer equipped with secondary windings that are coupled to the lamp electrodes. A current through the electrodes can in that case be detected either on the primary or on the secondary side of the transformer.

The first end of resistor R is connected to a first input terminal of circuit part IVa. Circuit part IVa together with ohmic resistor R forms a circuit part IV for detecting a current through the electrode of the lamp. Circuit part III and circuit part IV together form a circuit part II for detecting the presence of a lamp. The second end of ohmic resistor R is connected to a second input terminal of circuit part IVa. Circuit part IVa is coupled to circuit part I. This coupling is indicated by means of a dotted line. Circuit part V is a circuit part for periodically activating and deactivating circuit parts III and IV. A first output terminal of circuit part V is connected to an input terminal of circuit part III. A second output terminal of circuit part V is connected to an input terminal of circuit part IVa.

The operation of the circuit arrangement shown in FIG. 1 is as follows.

Figure 2:
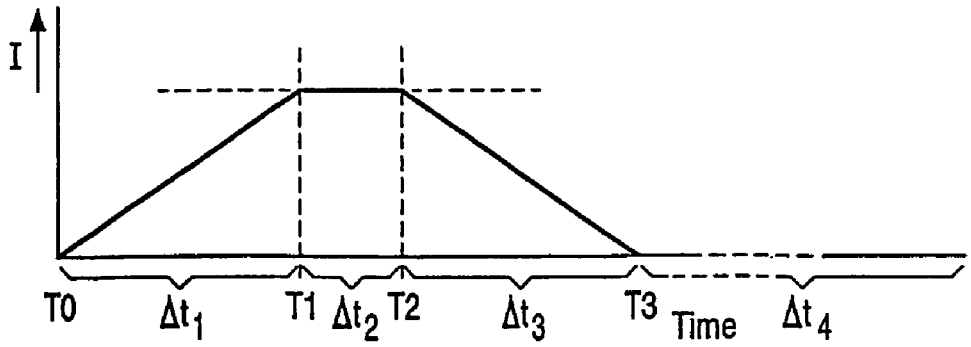
FIG. 2 shows the shape of the current through an electrode of the lamp as a function of time.

In case the input terminals K1 and K2 are connected to the poles of a supply voltage source, circuit part I will ignite the lamp connected to it, in case that lamp is not defective, and subsequently during stationary operation generate a lamp current through the lamp. Circuit part III generates a current through electrode E11 that has the shape illustrated in FIG. 2. In FIG. 2 time is plotted in arbitrary units along the horizontal axis and current in arbitrary units is plotted along the vertical axis. It can be seen that during a first time interval Δt1 the circuit part III is activated and the amplitude of the current through the electrode is gradually increased. During a second time interval Δt2 the amplitude of the current through the electrode is maintained at a substantially constant level. Only during this second time interval the circuit part IV is activated. Since the current has its maximum amplitude reliable detection is possible during this second time interval. During a third time interval Δt3 the amplitude of the current through the electrode is gradually decreased. During a fourth time interval Δt4 the circuit part III is deactivated and the current through the electrode is equal to zero. After the fourth time interval has lapsed the first time interval starts again.

In a practical embodiment of the invention the duration of one period (being the sum of the first, second, third and fourth time interval) was chosen as 2 seconds while the sum of the first, second and third time interval was chosen at 10 ms. As a result the power dissipation caused by circuit part III was reduced more than 200 times when compared with a situation in which a current with an amplitude equal to the maximum amplitude of the current shown in FIG. 3 flows through the electrode continuously.

In case the lamp is removed from the output terminals of circuit part I, electrode E11 is removed so that the current path between the output terminals of circuit part III is interrupted. Since no current flows through it the voltage over ohmic resistor R becomes zero which is detected by circuit part IVa. Via the coupling between circuit part IVa and circuit part L circuit part IVa prevents the generation of an ignition voltage by circuit part I. When a new lamp is connected to the circuit arrangement, its presence will be detected within one period. Via the coupling between the circuit part IVa and circuit part I this detection enables circuit part I to ignite this new lamp and operate it.

The invention claimed is:

1. Circuit arrangement for operating a lamp having heater electrodes, said circuit arrangement comprising input terminals for connection to the poles of a voltage supply source, a circuit part I coupled to the input terminals for igniting the lamp and for generating a lamp current out of a supply voltage delivered by the supply voltage source, a circuit part II, coupled to circuit part I, for detecting the presence of a lamp comprising a circuit part III for generating a current through a heater electrode of the lamp, a circuit part IV for detecting the current through the heater electrode of the lamp, characterized in that the circuit arrangement further comprises a circuit part V for periodically activating and deactivating of circuit parts III and IV.

2. Circuit arrangement according to claim 1, wherein the circuit part V comprises means for gradually increasing the amplitude of the current through the heater electrode during a first time interval, maintaining the amplitude of the current through the heater electrode at a substantially constant value during a second time interval and gradually decreasing the amplitude of the current through the heater electrode during a third time interval.

3. Circuit arrangement according to claim 1, wherein the circuit part V is equipped with delay means for activating the circuit part IV a predetermined delay time interval after the activation of circuit part III.

* * * * *